United States Patent [19]

von Beckmann

[11] 4,088,077

[45] May 9, 1978

[54] CONTINUOUS TAMPING DEVICE

[75] Inventor: Helmuth von Beckmann, Columbia, S.C.

[73] Assignee: Canron, Inc., Columbia, S.C.

[21] Appl. No.: 667,017

[22] Filed: Mar. 15, 1976

[51] Int. Cl.[2] ..... E01B 27/20

[52] U.S. Cl. ..... 104/12; 104/10; 404/117; 404/133

[58] Field of Search ..... 104/7 R, 10, 12, 14; 305/33, 35 EB, 10; 404/117, 121, 133

[56] References Cited

U.S. PATENT DOCUMENTS

| | | | |
|---|---|---|---|
| 1,568,241 | 1/1926 | Rimailho | 305/10 |
| 2,712,287 | 7/1955 | Zurmuhle | 104/12 |
| 2,855,862 | 10/1958 | Kind | 104/12 |
| 3,638,578 | 2/1972 | Helgemeir | 104/12 |
| 3,675,581 | 7/1972 | Plasser et al. | 104/12 |
| 3,807,311 | 4/1974 | Plasser et al. | 104/12 |
| 3,981,247 | 9/1976 | Theurer | 104/12 |

FOREIGN PATENT DOCUMENTS

| | | | |
|---|---|---|---|
| 737,432 | 9/1955 | United Kingdom | 404/117 |

*Primary Examiner*—Drayton E. Hoffman
*Assistant Examiner*—Randolph A. Reese
*Attorney, Agent, or Firm*—Wenderoth, Lind & Ponack

[57] ABSTRACT

A railroad track tamping machine for consolidating and compacting railroad track ballast includes ballast tampers, preferably rollers, adapted to roll over and between the ties, and guides for the rollers to guide them in a manner such that the rollers either roll over and between the ties or along the shoulders. The rollers are mounted in the guides and vibrator arrangements are provided for vibrating the rollers during operation thereof to consolidate and compact the ballast. In a preferred embodiment, the vibrator arrangement comprises a hydraulic system whereby the roller means are vibrated due to rapid fluctuations created in the system. Preferably the rollers are arranged in a set and are located one after the other so that each roller rolls over the same area of the ties and ballast as the other rollers of the set as the device moves once over a length of railroad track to be consolidated. When the hydraulic system is used to vibrate each of the rollers in the set, advantageous centipede-type action results.

12 Claims, 7 Drawing Figures

CONTINUOUS TAMPING DEVICE

This invention relates to a railroad track tamping machine for consolidating and compacting ballast underneath and between railroad ties.

BACKGROUND OF THE INVENTION

There are various railroad track tamping machines available and it is the primary object of the present invention to provide a novel machine of this type which will operate on the ballast in a continuous manner.

SUMMARY OF THE INVENTION

According to one aspect of the present invention there is provided a railroad track tamping machine for consolidating and compacting ballast underneath and between railroad ties comprising tamping means, means for mounting said tamping means on said machine and for guiding them in a path such that, in operation, they move over and between said ties in pressure contact, with the ballast and the ties, and means for vibrating said tamping means, during operation thereof, to consolidate and compact said ballast.

According to another aspect of the invention there is provided a railroad track tamping machine wherein said tamping means comprise roller means adapted to roll over and between said ties.

In a preferred embodiment, the tamping means are rollers and the vibrating means comprises a hydraulic system whereby the rollers are vibrated due to rapid fluctuations created in the system. A hydraulic vibrating system has a number of advantages over a mechanical-type of vibrating system, one of these being the fact that there is less likelihood of damage either to the tamping machine or to the ties themselves due to the relative ease with which safety devices, such as relief valves, can be built into the device.

Preferably the rollers are in the form of sets of rollers, the rollers in each set being located one after the other and spaced a distance unequal to the spacing of the ties so that each roller rolls over the same area of the ties and ballast as the other rollers of the set as the device moves once over a length of railroad track to be consolidated. When the hydraulic system is used to vibrate each of the rollers in the set, an advantageous centipede-type action results. When one roller is moved upwards as it rolls over a tie, this causes hydraulic fluid in the system to be displaced to the vibrating mechanism of an adjacent roller which is presently between two ties. This adjacent roller thus tends to be displaced downwardly so as to compact the ballast between the ties. Also, with a downward compacting force being applied at the same time to both the ties and the ballast between the ties by the set of rollers, there is a greater chance of ballast, both between and underneath the ties, being consolidated by the rollers rather than merely displaced to a position away from the rollers.

In the preferred embodiment of the present invention, the amplitude of the vibration in each roller of the set is a function of the resistance of the material presently in contact with the roller. This causes loose ballast to be tamped considerably by the machine of the present invention and some of the ballast at least will be moved underneath adjacent ties. The vibrations of the roller will naturally find less resistance and thus be greater in the loose ballast than will be the vibrations of the roller which is presently in contact with the top of a tie.

Embodiments of the present invention will now be described, by way of example, with reference to the accompanying drawings.

DETAILED DESCRIPTION OF PREFERRED EMBODIMENTS

Figure 1:
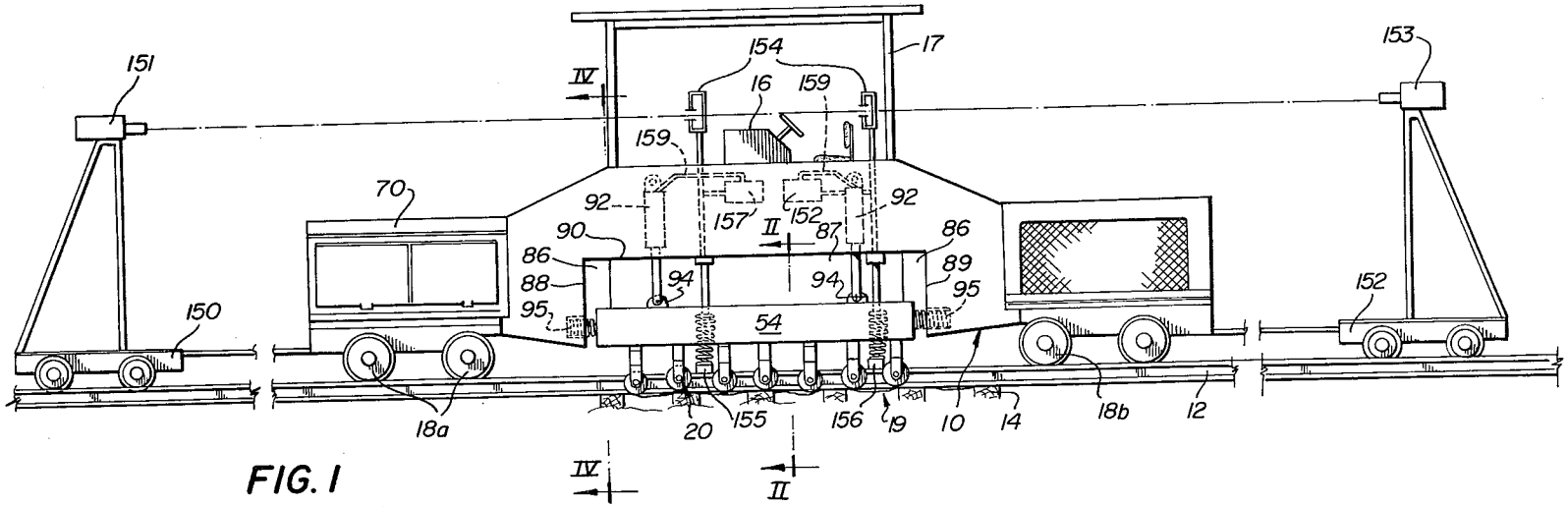
FIG. 1 is a schematic side elevation of a tamping machine which is also provided with means for determining the position and correcting the surface of the track.

As shown in FIG. 1 of the drawings, the railroad track tamping machine generally designated by the numeral 10 is provided with ballast tamping roller means 20 mounted midway between the machine rail wheels 18*a* and 18*b*.

Figure 2:
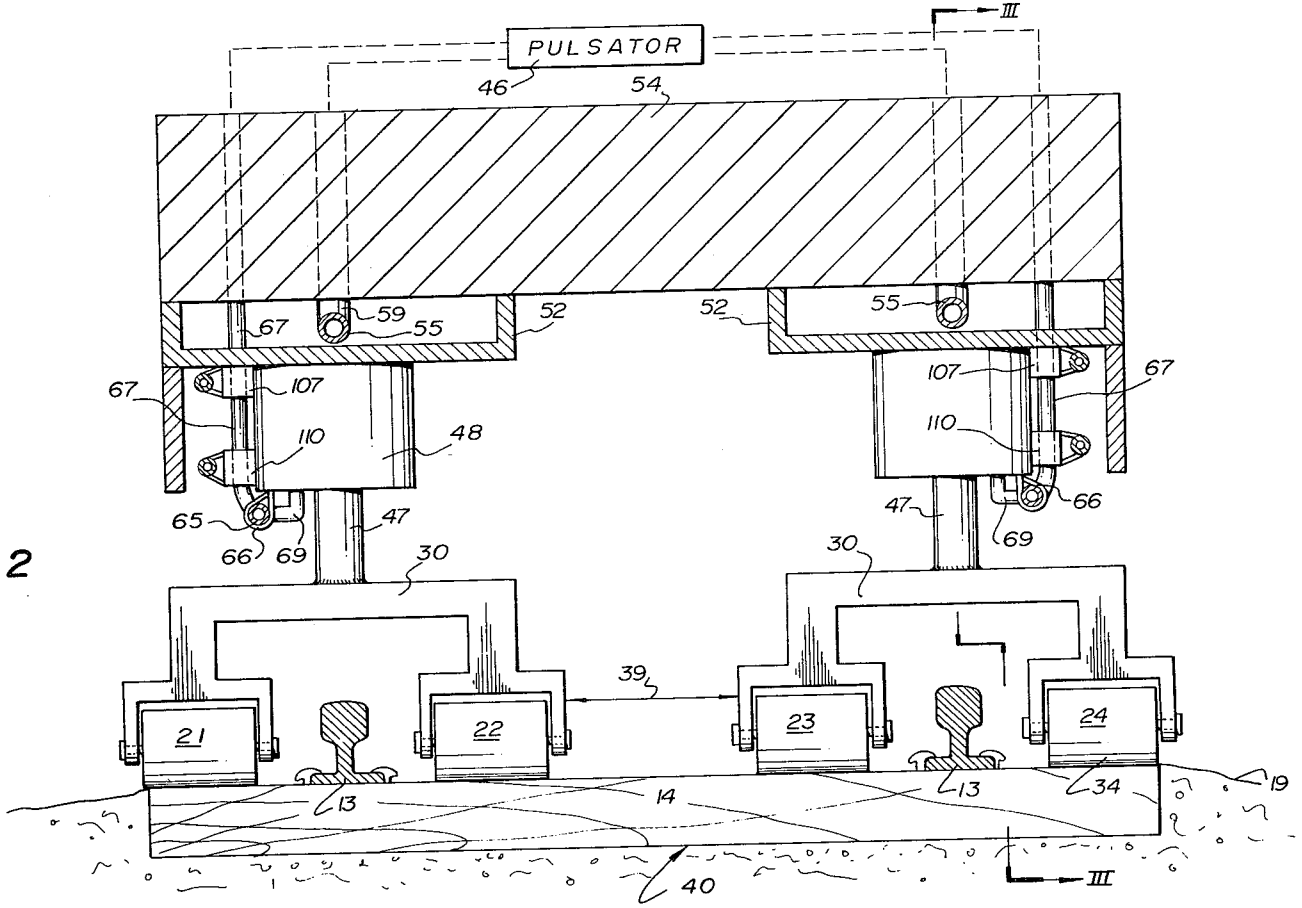
FIG. 2 is a sectional view of the arrangement of the vibrating rollers relative to the track taken along line II—II of FIG. 1.

The roller means 20 are adapted to roll over and between the ties 14 without causing any significant damage to the ties. In the embodiment of FIGS. 1 and 2, the roller means consists of four sets of rollers 21 to 24. Only the set of rollers 21 can be seen in FIG. 1. Each set of rollers comprises a number of rollers located one behind the other in a row extending in the longitudinal direction of the track 12 and spaced a distance unequal to the spacing of the ties. Conveniently each set of rollers is transversely aligned with every other set. In the embodiment of FIG. 1, each set has seven individual rollers, each of which is adapted to roll over the same area of the ties 14 and the ballast 19 as the other rollers of the same set while the tamping machine moves once over the length of railroad track to be consolidated.

The rollers are rotably mounted in pairs in bearings in common inverted U-shaped bracket members 30 so that sets 21 and 22 closely straddle one rail and sets 23 and 24 closely straddle the other rail.

The tamping machine of the present invention provides means for vibrating the roller means 20 during operation thereof to consolidate and compact the ballast 19. The vibrating means preferably comprises a hydraulic system best seen in FIG. 3 of the drawings. The roller means 20 are thus vibrated due to rapid fluctuations created in the hydraulic system. The hydraulic system generally consists of a hydraulic pulsator 46, roller piston members 47 for the rollers, roller hydraulic cylinders 48, and a system of connecting lines for transporting hydraulic fluid to and from the hydraulic pulsator and the hydraulic cylinders 48. In the illustrated embodiment, each bracket 30 is rigidly connected to the bottom of one of the piston members 47.

As an alternate arrangement to that described above, each row of rollers can have its own hydraulic cylinders 48 rather than sharing its cylinders 48 with an adjacent row. Thus each roller would be mounted on a separate piston member 47. Such an arrangement, although more complex, permits each roller to act completely independently of rollers in other rows so that each roller is better able to adapt to its own particular tamping and rolling situation.

Each hydraulic cylinder 48 is rigidly connected to the bottom of a channel member 52 which extends longitudinally of the tamping machine 10. There are two of these channel members 52, these being shown in cross-section in FIG. 2, and they extend parallel to each other along the bottom of a weighting device 54 which consists basically of a large, horizontal, generally plate-like member having a substantial weight. The weight of the device 54 is transferred to the rollers of the roller means 20 and thus the weight of the device 54 contributes to the consolidating and compacting capabilities of the tamping machine. Extending down the center of each channel member 52 is a hydraulic hose 55 which is completely encased in its channel member and communicates with the pulsator via hose 59. The hose 55 is closed at each end and is in open communication with each cylinder 48 below the hose by means of openings 56 distributed along the length of the hose and located in the bottom thereof (see FIG. 3). The openings 56 are immediately above and are in open communication with holes 57 in the adjacent channel member 52.

A further hydraulic hose 65 extends along the bottom outside edges of each row of hydraulic cylinders 48. The hose 65 is supported in suitable bracket members 66 rigidly connected to the bottom of each of the hydraulic cylinders 48. Each of the two hoses 65 is closed at both ends and is in open communication with the pulsator 46 by means of a hose 67 connected to the center of the hose 65. The hose 65 is connected to the interior of each cylinder 48 below the piston by means of a short, right angle connecting hose or pipe 69.

The hydraulic pulsator and its associated apparatus can be mounted in the front portion of the machine or in the center section of the machine above the tamping means.

With the tamping machine of the present invention, means are provided for guiding the roller means 20 in a manner such that the roller means roll over and between the ties. The brackets 30, piston members 47, and hydraulic cylinders 48 form part of this guide means. In addition, vertical guide members 86 are rigidly connected to the machine at the front and the back of the weighting device 54 to maintain the roller means 20 in proper alignment relative to the rails 13. The bottom portion 87 of the machine is open in order to form a large receiving chamber for the device 54. This bottom portion is defined by front and rear walls 88 and 89 and a horizontal, downwardly facing wall 90. Two guide members, 86, which can take the form of channel members, are welded to each of the front and rear walls 88 and 89 and these guide members extend most of the height of these walls. The weighting device 54 is formed with two recesses 91 at its front end and two recesses at its rear end, these recesses receiving the guide members 86. Thus the weighting device 54 is free to move upwardly or downwardly but any substantial movement thereof and thus of the rollers in the transverse direction is prevented by the guide members 86.

Preferably, two hydraulic cylinders 92 are provided, which can be actuated to raise the tamping means to a position well above the rails 13 so that the machine can move quickly between job locations, these cylinders being mounted in the machine and having their piston rods attached to weighting device 54 as at 94.

The hydraulic cylinders 92 preferably also serve a second function for the present tamping device. They permit the load on the rollers to be varied to satisfy different tamping requirements. For example, the hydraulic cylinders 92 can be used simply to lower the rollers until they contact the roadbed to be compacted. In this situation, the rollers merely carry the weight of the weighting device 54 and the cylinders 92 basically serve only to help guide the tamping means along the track. However, if the job calls for a greater weight to be applied to the rollers as they vibrate, some of the weight of the machine itself can be transferred to the tamping device through the cylinders 92 simply by increasing the hydraulic pressure in the cylinders 92. A relief valve can of course be built into each of the hydraulic lines feeding the cylinders 92 in order to prevent an extensive build-up of pressure in the cylinders.

Figure 4:
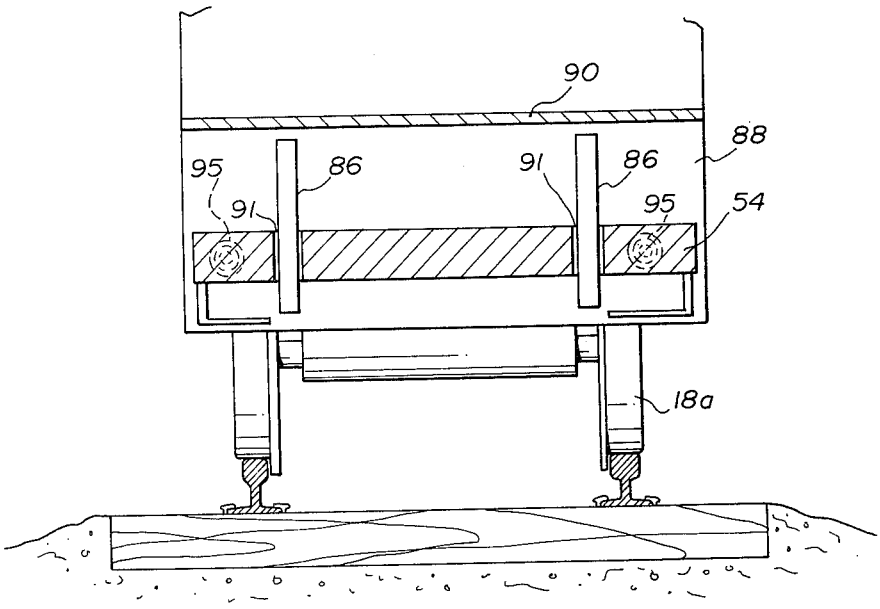
FIG. 4 is a sectional elevation along the line IV—IV of FIG. 1 showing the means for guiding the tamping machine along the track.

A couple of coil springs 95 can be arranged at each end of the weighting device 54. Each of the springs is held in a cylindrical recess formed in either the front or rear wall, 88 or 89. These springs provide a highly resilient cushion between the tamping means and the rest of the machine and help to prevent damage to the ends of the tamping means as the machine stops and starts. The springs also help to maintain the tamping means away from the front and rear walls 88 and 89 so that the transfer of vibrations from the tamping means to the rest of the machine is kept at a minimum. In lieu of the coil springs 95, large rubber pads could be used to provide a cushion. As can be seen in FIG. 4, the two springs 95 at the front of the tamping device are arranged at each side of the weighting device 54 and outside of the guide members 86. The springs 95 at the rear are arranged in a similar manner.

Figure 3:
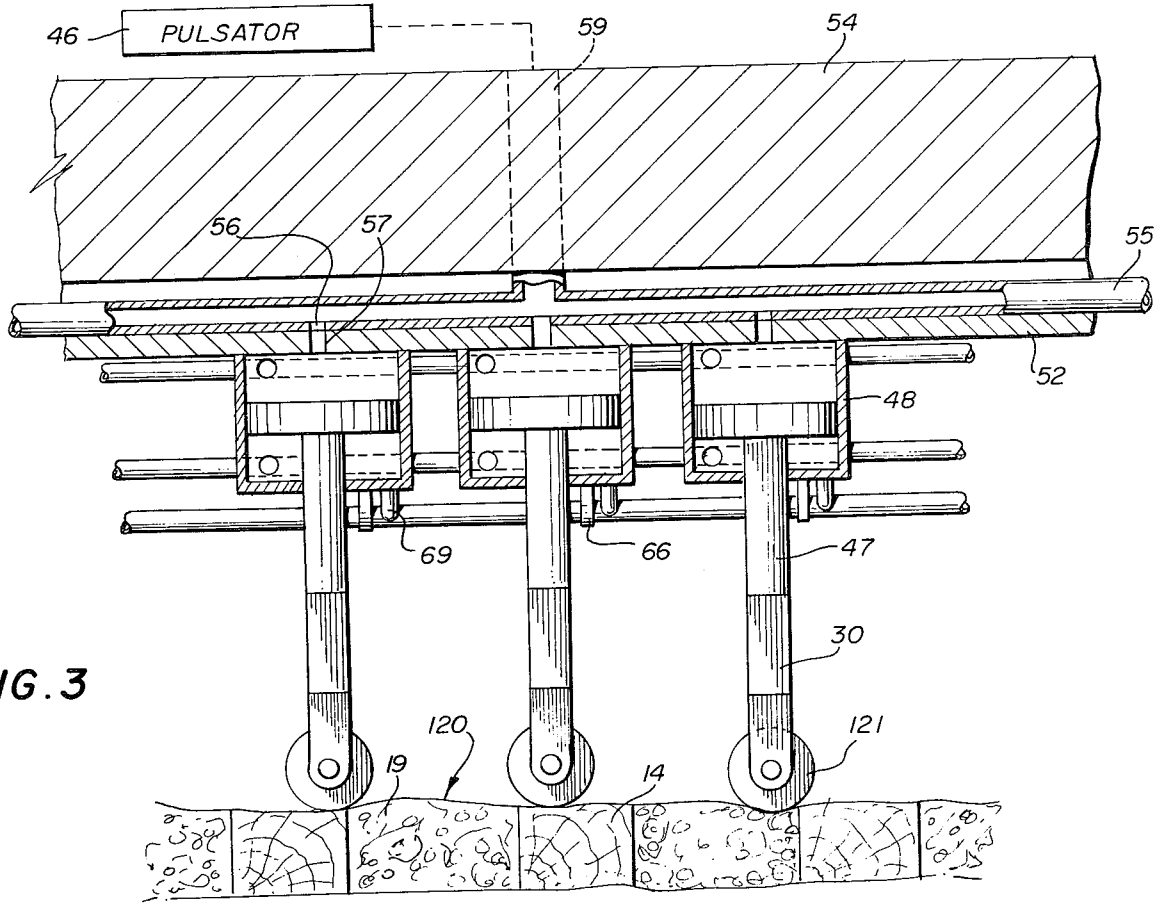
FIG. 3 is a sectional view of three vibrating rollers of a set taken along the line III—III of FIG. 2.

The advantage of the use of a hydraulic system to vibrate the rollers and of the use of a number of rollers following one after the other can be seen from an examination of FIGS. 1 and 3 of the drawings. The ties 14 of the track are generally at a higher level than the tamped ballast 19 between the ties. However, in some cases, an excess amount of ballast may exist between two ties as indicated at 120 in FIG. 3. Whatever may be the case, it will be readily seen that the rollers must be capable of moving up and down (in addition to the usual vibrating movement) as the rollers move along the length of track to be consolidated and compacted. One roller may be going up at one instant in time as it meets a railroad tie while another roller in the same set may be moving downwards (such as the roller indicated by the numeral 121 in FIG. 3 as it descends from a tie 14 to the level of the adjacent ballast. Thus, the rollers of the roller means 20 of the present invention should be capable of undergoing a "centipede" type action as they are moved along the track. The movement of one roller in an upwards direction will cause hydraulic fluid to be displaced from above the piston in its associated cylinder into the other cylinders, and particularly the cylinders of those rollers moving in a downward direction. Similarly, the downward movement of the roller 121 will cause its piston to displace hydraulic fluid from the lower end of its cylinder into the cylinders of those rollers which are moving in an upward direction at that time. Of course, the greater the number of rollers employed in each set, the greater the likelihood of this movement of fluid from one chamber to another balancing out. If it should somehow happen that all or most of the rollers are being displaced upwardly at a certain point of time, then pressure valves 107 (FIG. 2) provided adjacent the upper ends of the cylinders 48 would open to release excess hydraulic fluid as soon as the pressure exceeded the predetermined level of these valves. Similarly if all or most of the rollers happen to move downwardly at a point in time, pressure valves 110 adjacent the lower ends of the cylinders would open once the pressure exceeded the predetermined level.

Figure 5:
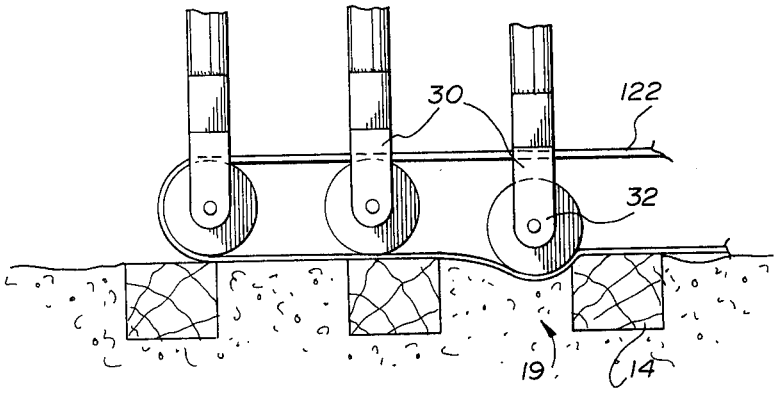
FIG. 5 is a view similar to FIG. 3 but showing an alternative tamping machine of the present invention.

An alternative form of roller means is shown in part in FIG. 5 in which all of the rollers in each set are surrounded by a continuous flexible belt 122 which moves about the rollers as they rotate. The belt helps to prevent the rollers from damaging the ties 14, particularly where the ties are made of a very rigid material such as concrete. The belt also helps the rollers to move smoothly over the ties, particularly where there is a great depression between two adjacent ties. One further advantage of this caterpillar-type arrangement is that the belt 122 tends to prevent any wave motion in the ballast as it is being compacted by the rollers, such a motion being generally undesirable as it may cause the ballast to be moved to places where it is not required from areas where it is required.

Figure 6:
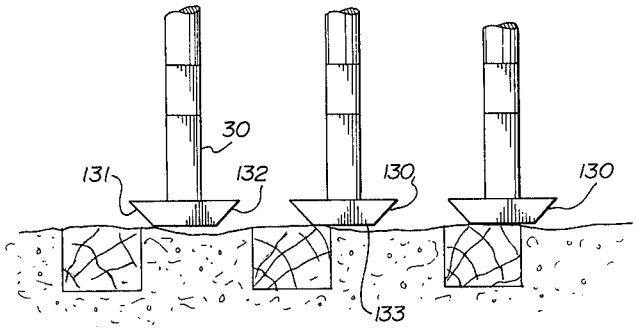
FIG. 6 is a view similar to FIGS. 3 and 5 but showing the use of sliding vibrating plates rather than roller means.

Instead of using the roller means 20 shown in FIGS. 1 to 3 of the drawings, it is of course possible to use tamping means in such forms as the sliding vibrating plates 130 shown in FIG. 6 of the drawings. These plates would be arranged in the same manner as the rollers of the roller means 20 but would be rigidly connected to the bracket members 30. Each vibrating plate 130 is preferably formed with a sloping front wall 131 and a sloping rear wall 132 in order to permit the sliding plates to move easily over the ties 14. Each sliding plate 130 may be formed with a flat bottom 133 as shown or the bottom can be slightly rounded so as to further assist in the movement of the plates over the ties. Making the bottoms 133 slightly rounded could also assist in concentrating the compacting forces created by the vibrations so that the plates are better able to compact the ballast.

Figure 7:
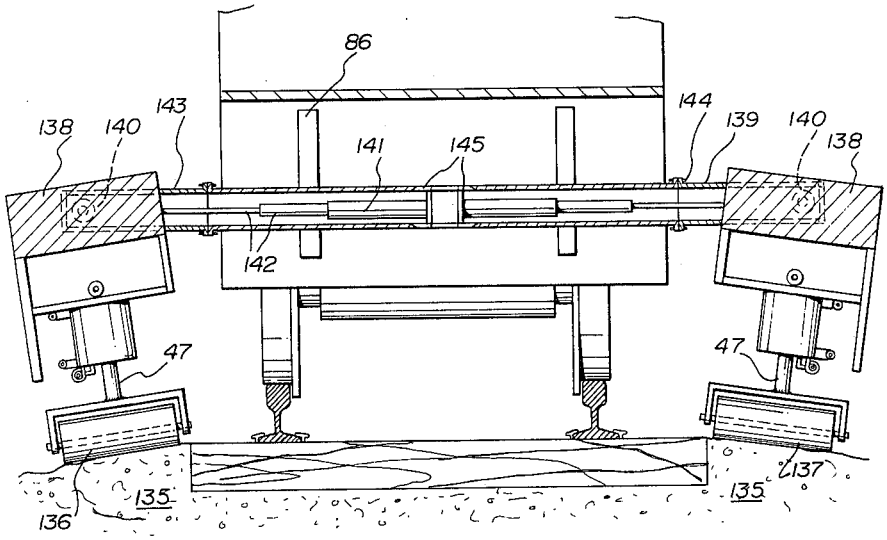
FIG. 7 is a schematic view similar to FIG. 2 wherein the vibrating rollers are adapted to consolidate the shoulders of the roadbed.

FIG. 7 of the drawings shows how a set of vibrating rollers arranged on each side of a suitable railroad vehicle such as that shown in FIG. 1 can be used to consolidate and compact the shoulders of the roadbed rather than the ballast between and underneath the ties. In FIG. 7, the two shoulders of the track are indicated at 135. Each shoulder 135 is being compacted by a special set of rollers 136 or 137. In this embodiment, each set of rollers has its own weighting device 138 which is located directly above the respective set of rollers. Each weighting device 138 is connected at each longitudinal end to a transversely extending channel-type frame member 139. This frame member 139 forms a track for a large roller or wheel 140 rotatably mounted at each end of the weighting device 138. This roller is free to roll between the two horizontal flanges of the frame member 139 in the horizontal direction. Thus, means are provided for bringing each of the shoulder tamping devices within the track profile in order that the vehicle is free to move on the track between job locations without interfering with bridge abutments, tunnels etc. A hydraulic cylinder 141 and telescoping hydraulic pistons 142 are mounted at each side of each frame member 139 in order to provide power means for bringing each of the tamping devices within the track profile or for extending these devices to their working position. Once the shoulder tamping devices have been brought within the track profile so that the rollers 140 are situated on the inner halves of each side of the frame member 139, the outer section 143 at each end of the frame member 139 can be disconnected for transport by removing the bolts 144. In this way, the outer portions of each frame member 139 will also not interfere with movement of the vehicle between job sites.

It will be understood that each of the frame members 139 is adapted to slide up and down on the guide members 86 in somewhat the same manner as the weighting device 54 in FIG. 4. The two frame members 139 are connected at their centers by two channel-type frame members 145 extending in the longitudinal direction of the vehicle. It will be understood that the hydraulic cylinders 92 shown in FIG. 1 are connected to the frame members 145 in the embodiment of FIG. 7.

Returning now to FIG. 1 of the drawings, the tamping machine of the present invention is preferably provided with means for determining the proper surface of the track whose ballast is being consolidated and compacted by the machine.

In the tamping machine shown in FIG. 1, a lead car 150 with a light beam projector 151 is attached to the front of the car 11 so that there is a predetermined distance between the lead car and the car 11. To the rear of the vehicle 11 a trail car 152 with a light beam receiver 153 is attached at a suitable distance from the back of the car 11.

Two shadowboards 154 are mounted on the vehicle 11 to cooperate with projector 151 and receiver 153. Each of the shadowboards 154 is adapted to operate independently of the other and is referenced to the grade of the track 12 located immediately below it as indicated at 155 and 156. Thus whenever the grade of the track at 155 falls below the desired level in reference to the grades of the track at the position of cars 150 and 152, the first shadowboard 154 will cut off (for example) the light coming from projector 151 so that none or little light is being received by receiver 153. Receiver 153 will then send a signal in a known manner to the control box 157. The control box 157 which may comprise a solenoid operating a hydraulic valve, will then cause the front piston member 93 to move upwardly with respect to the first hydraulic cylinder 92 so that the forward end of the tamping device is no longer consolidating the ballast at 155 or, if consolidating, is consolidating to a much lesser extent due to the removing of weight on the leading rollers. Similarly, if the track grade at 156 is at or below the desired grade, the rear shadowboard 154 will cut off or lessen the light coming from projector 151 to receiver 153. This will cause a signal to be emitted by the receiver 153 to the control box 158. The solenoid in control box 158 will send a signal through line 159 so as to move the hydraulic valve adjacent the rear cylinder 92 to the open position. In this way hydraulic fluid will be released from one end of the cylinder 92 and will be pumped into the other end to raise the rear end of the weighting device 54. As soon as the shadowboard 154 signals that the track at 156 again is above the required grade (i.e. by letting the required amount of light be received by the receiver 153), the receiver 153 will send a signal to the solenoid of control box 158 which in turn will close the aforementioned valve. The hydraulic pressure in the cylinder 92 will then force the piston 93 downwardly so that the rear of the tamping device is again applying its full normal tamping force to the roadbed and ties.

In lieu of the arrangement shown in FIG. 1, it is possible to have a light beam projector, light beam receiver and shadowboard arrangement control a track lifting hydraulic jack as is known in the art.

What I claim as my invention is:

1. A railroad track tamping machine for consolidating and compacting ballast underneath and between railroad ties comprising at least one set of tamping elements, the elements in said set being spaced in the direction of the length of the track a distance unequal to the spacing of the ties, means for mounting said tamping elements on said machine and for guiding them in a path such that, in operation, they move over the upper surface of the ties and over the upper surface of the ballast between said ties in pressure contact with the ballast and the ties, and means for vibrating said tamping elements, during operation thereof, to consolidate and compact said ballast, said vibrating means comprising a hydraulic system including means to create a rapid fluctuation of hydraulic pressure therein whereby said tamping elements are vibrated, said hydraulic system also comprising a series of cylinders, pistons mounted in said cylinders, piston rods extending downwardly from said pistons and each having a said tamping element mounted on the lower end thereof, and pressure equalizing conduit means for feeding hydraulic fluid to said cylinders, the hydraulic connection being such that, forced movement of one piston in either direction at any given moment will feed pressurized fluid from its associated cylinder into said conduit means for distribution to any others of said cylinders in which the pistons are moving in the opposite direction at that given moment, whereby the force of a tamping element on a tie prevents the undesirable raising of the tie due to the compaction of the ballast between the ties and hence provides a uniform compaction throughout the entire ballast structure, and the work done by the different cylinders and pistons for each tamping element is automatically equalized.

2. A railroad track tamping machine according to claim 1 wherein said tamping elements comprise roller means adapted to roll over and between said ties.

3. A railroad track tamping machine according to claim 1 wherein said tamping elements include four sets, two of said sets closely straddling each rail.

4. A railroad track tamping machine according to claim 3 wherein said hydraulic system comprises a vibrating means for said sets of tamping elements and said vibrating means having a single source of the fluctuations for vibrating the tamping elements in said sets.

5. A railroad track tamping machine according to claim 1 including means for determining the actual position of rails mounted on said railroad ties, means for determining the proper position of said rails in order for the track formed thereby to be smooth, and means for adjusting said tamping elements so as to increase or decrease their ability to consolidate and compact said ballast depending on the location of said actual position relative to said proper position.

6. A railroad track tamping machine according to claim 5 wherein said tamping elements comprise roller means adapted to roll over and between said ties.

7. A railroad track tamping machine according to claim 1 wherein the tamping elements are plate means adapted to slide over and between said ties.

8. Machine as claimed in claim 1 in which said pressure-equalizing conduit means comprises a common conduit for connecting pressurized fluid to said series of cylinders said conduit having connecting means in parallel communicating with said cylinders individually.

9. A railroad track tamping machine according to claim 1 wherein said means to create a rapid fluctuation is a hydraulic pulsator.

10. A railroad track tamping machine according to claim 1 wherein said set of tamping elements is surrounded by a continuous flexible belt to protect said ties from damage from the vibrating tamping elements and to assist said tamping elements to move over and between said ties.

11. A railroad tamping machine according to claim 1 further including a weighting device mounted on said set of tamping elements, and hydraulic cylinder means for loading said weighting device to exert a predetermined load on said tamping elements.

12. A railroad track tamping machine according to claim 11 including relief valve means hydraulically connected to said hydraulic cylinder means to release hydraulic fluid from said cylinder means when the load on said tamping elements exceeds said predetermined load.

* * * * *